US009433270B2

(12) United States Patent
D'Angelo

(10) Patent No.: US 9,433,270 B2
(45) Date of Patent: Sep. 6, 2016

(54) UNIVERSAL WHEELED BAG SYSTEM

(71) Applicant: Eduardo Felipe D'Angelo, Miami, FL (US)

(72) Inventor: Eduardo Felipe D'Angelo, Miami, FL (US)

(73) Assignee: Eduardo F. D'Angelo, Miami, FL (US)

( * ) Notice: Subject to any disclaimer, the term of this patent is extended or adjusted under 35 U.S.C. 154(b) by 0 days.

(21) Appl. No.: 13/815,686

(22) Filed: Mar. 14, 2013

(65) Prior Publication Data

US 2014/0262660 A1 Sep. 18, 2014

(51) Int. Cl.
*A45C 5/14* (2006.01)
*A45C 13/26* (2006.01)

(52) U.S. Cl.
CPC ..... *A45C 5/146* (2013.01); *A45C 13/262* (2013.01); *A45C 2013/267* (2013.01)

(58) Field of Classification Search
CPC ..... A45C 5/146; A45C 2013/267
USPC ..... 190/18 A, 115; 16/19.32, 113.1
See application file for complete search history.

(56) References Cited

U.S. PATENT DOCUMENTS

| | | | | |
|---|---|---|---|---|
| 1,176,876 | A * | 3/1916 | Vartabledian | 280/35 |
| 1,884,636 | A * | 10/1932 | Faus | 280/43.14 |
| 2,581,417 | A * | 1/1952 | Jones | 280/645 |
| 3,178,197 | A * | 4/1965 | Boatner | 280/37 |
| 4,122,924 | A * | 10/1978 | Wasserman | 190/18 A |
| 4,397,062 | A * | 8/1983 | Huang | 16/33 |
| 5,813,503 | A * | 9/1998 | Chang | 190/18 A |
| 5,956,805 | A * | 9/1999 | Huang | 16/33 |
| 6,179,176 | B1 * | 1/2001 | Saggese et al. | 224/153 |
| 6,360,400 | B1 * | 3/2002 | Chang | 16/113.1 |
| 7,717,440 | B1 * | 5/2010 | Baba | 280/47.371 |
| 2002/0095746 | A1 * | 7/2002 | Wang | 16/405 |
| 2003/0041409 | A1 * | 3/2003 | Caporale | 16/19 |

* cited by examiner

*Primary Examiner* — Sue A Weaver
(74) *Attorney, Agent, or Firm* — Laurence J. Edson

(57) ABSTRACT

A wheeled bag system having a bag with a handle at one end and a wheel system at the other, with a toothed handle-shuttle system moving wheels between exposed when the handle is pull and hidden positions when the handle is push folding the wheels into a cavity in the wheel system.

2 Claims, 7 Drawing Sheets

UNIVERSAL WHEELED BAG SYSTEM

This Continuation in Part application claim priority of U.S. Non-Provisional patent application Ser. No. 13/374,864 filed on Jan. 19, 2012, now abandoned, and the Continuation in Part Ser. No. 13/573,250 filed on Sep. 5, 2012, now abandoned, to Eduardo D'Angelo for Universal Wheeled Bag System.

BACKGROUND OF THE INVENTION

1. Introduction

Wheels are useful for moving objects. Manufacturers commonly place wheels on luggage. Wheels make moving the luggage easier. However, when you are not wheeling the luggage, the wheels get in the way and risk being damaged or causing damage.

2. Field of the Invention

The present invention relates to a wheeled system for luggage. Wheels on the luggage are either exposed or concealed, depending on whether a user is wheeling the luggage, or the luggage is stationary or stowed.

3. Description of the Prior Art

Wheeled luggage is disclosed in U.S. Patents. For example, U.S. Pat. No. 7,997,591 to Arthur teaches a chassis with retractable wheels, wherein the chassis includes a housing.

U.S. Pat. No. 7,861,834 to Gorga teaches retractable wheel system for towable baggage.

U.S. Pat. No. 7,066,311 to O'Shea teaches a retractable wheel assembly for a carrier. A retractable wheel assembly (110) for a carrier (100) is disclosed wherein the wheels (120) are rotatably mounted in cowls (130), which are pivotably disposed in wheel wells (116L, 116R) on a housing. The cowls are connected with a cowl axle assembly (140) that includes a coil spring, preferably a constant force spring (150) that biases the cowls towards a retracted position. The constant force spring is connected to a retractable handle (104), preferably with a spring engagement member (160), such that extending the retractable handle will bias the cowls towards an extended position, wherein the wheels extend out of the wheel wells for use.

BRIEF SUMMARY OF THE INVENTION

It is an object of the present invention to provide a wheeled bag system with a lock that a user can manipulate to move luggage wheels between exposed and hidden positions.

Another object of the present invention is to provide a handle lock of the luggage for a wheeled system a user manipulates by pull up and push down the handle.

Yet another object of the present invention is to provide a wheeled system where the wheels fold in and up into a cavity at the bottom of an article of luggage.

Other objects and further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWING

The present invention will be better understood from the detailed description given herein below and the accompanying drawings with which are given by way of illustration only.

DETAILED DESCRIPTION OF THE INVENTION

Figure 1:
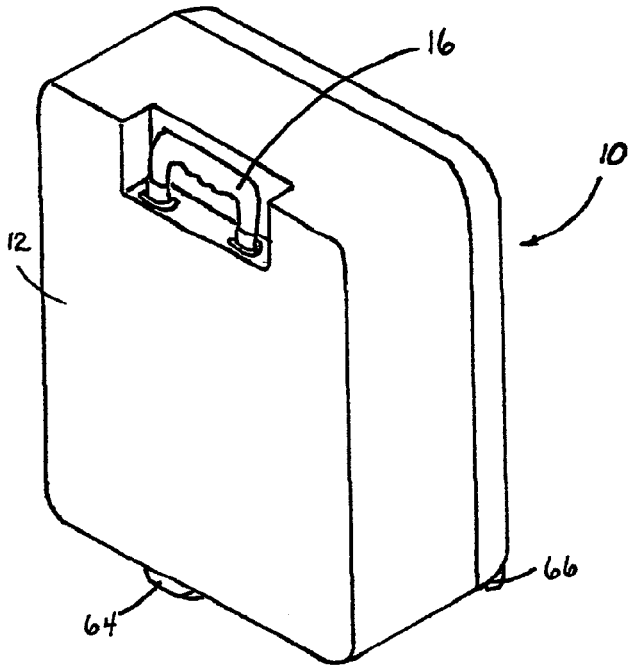
FIG. 1 shows the perspective view of the luggage when the handle is push down and the wheels are hidden.
Figure 2:
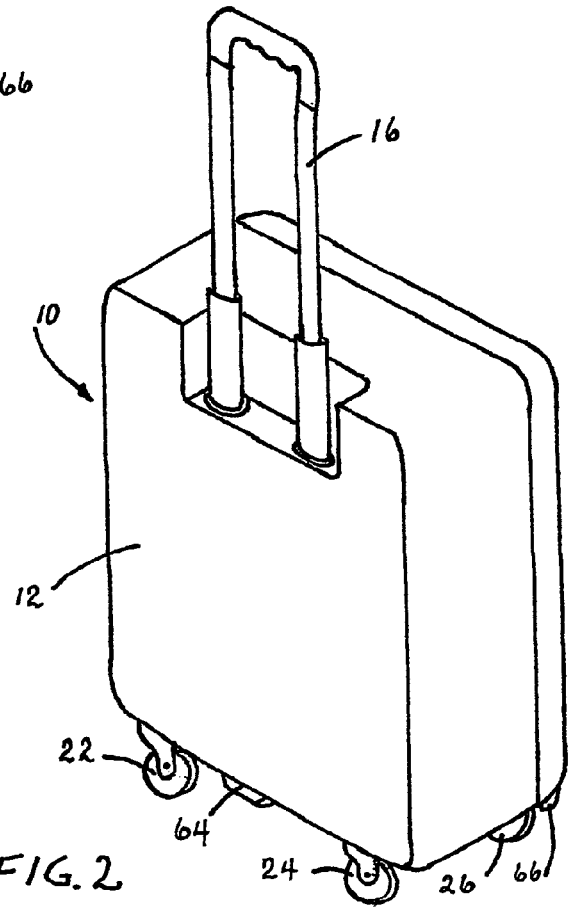
FIG. 2 shows the perspective view of the luggage when the handle is pull up and the wheels are exposed.
Figure 10:
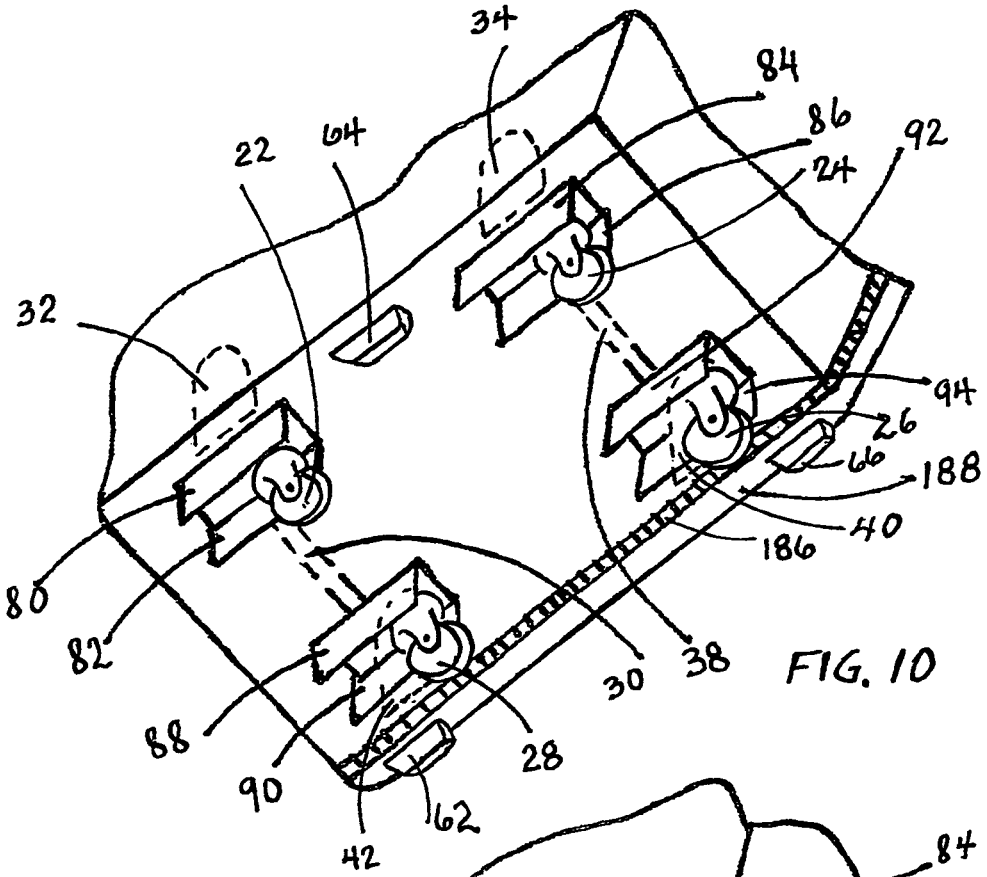
FIG. 10 shows a perspective view of the bottom of the luggage with the wheels exposed and flaps open.

FIG. 1 and FIG. 2 illustrate the wheeled luggage system 10 of the present invention. Here, one sees a conventional bag 12 with a modified extended handle 16 and first, second and third wheels, 22, 24, 26, although, as seen in FIG. 10, there are typically first, second, third and fourth wheels 22, 24, 26, 28. For purposes of orientation, it is helpful to characterize the bag as having handle and wheel system ends.

Figure 3:
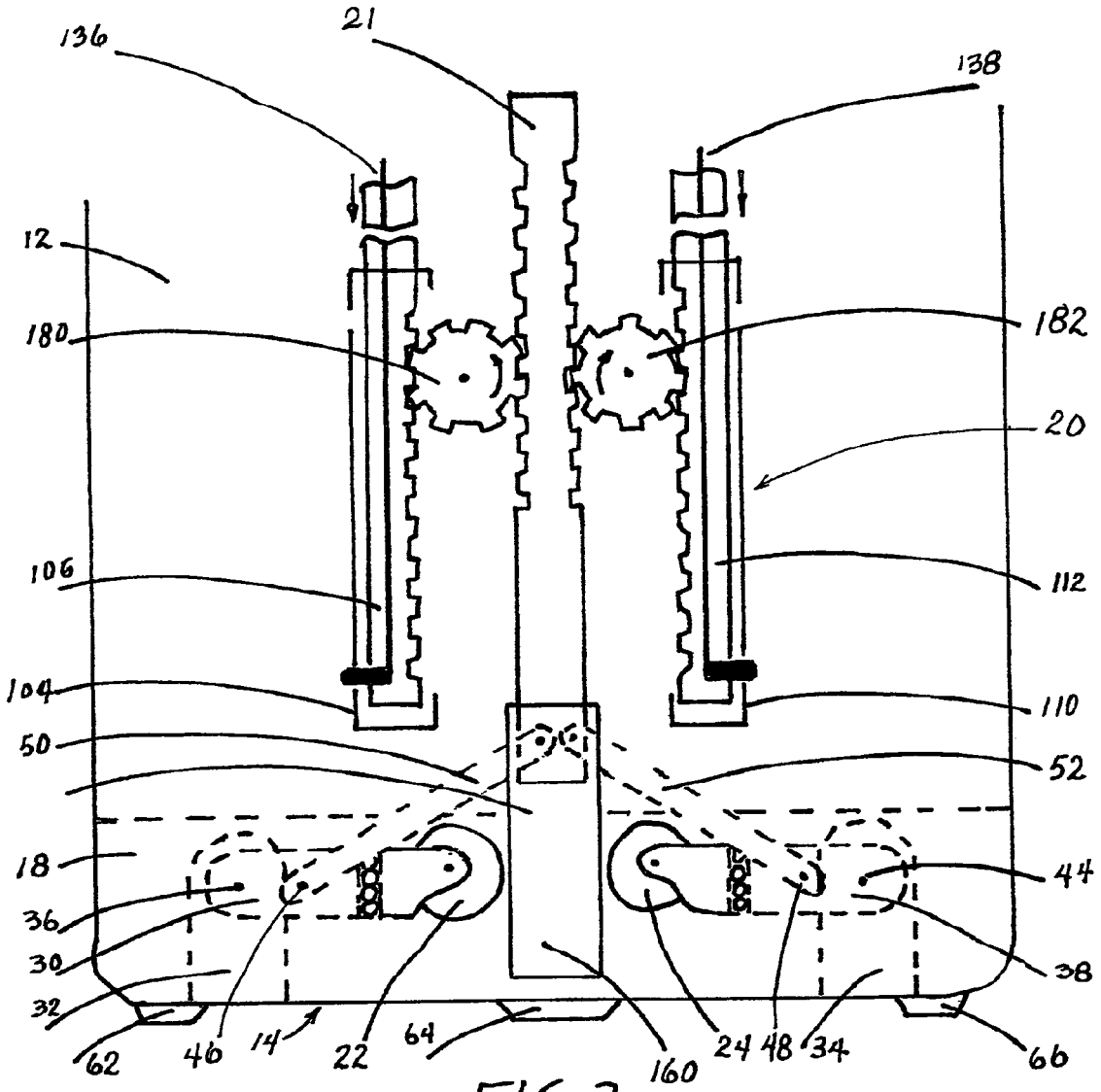
FIG. 3 shows a transparent frontal view of the toothed handle-shuttle system, with the lock placing the wheels in the hidden position.
Figure 4:
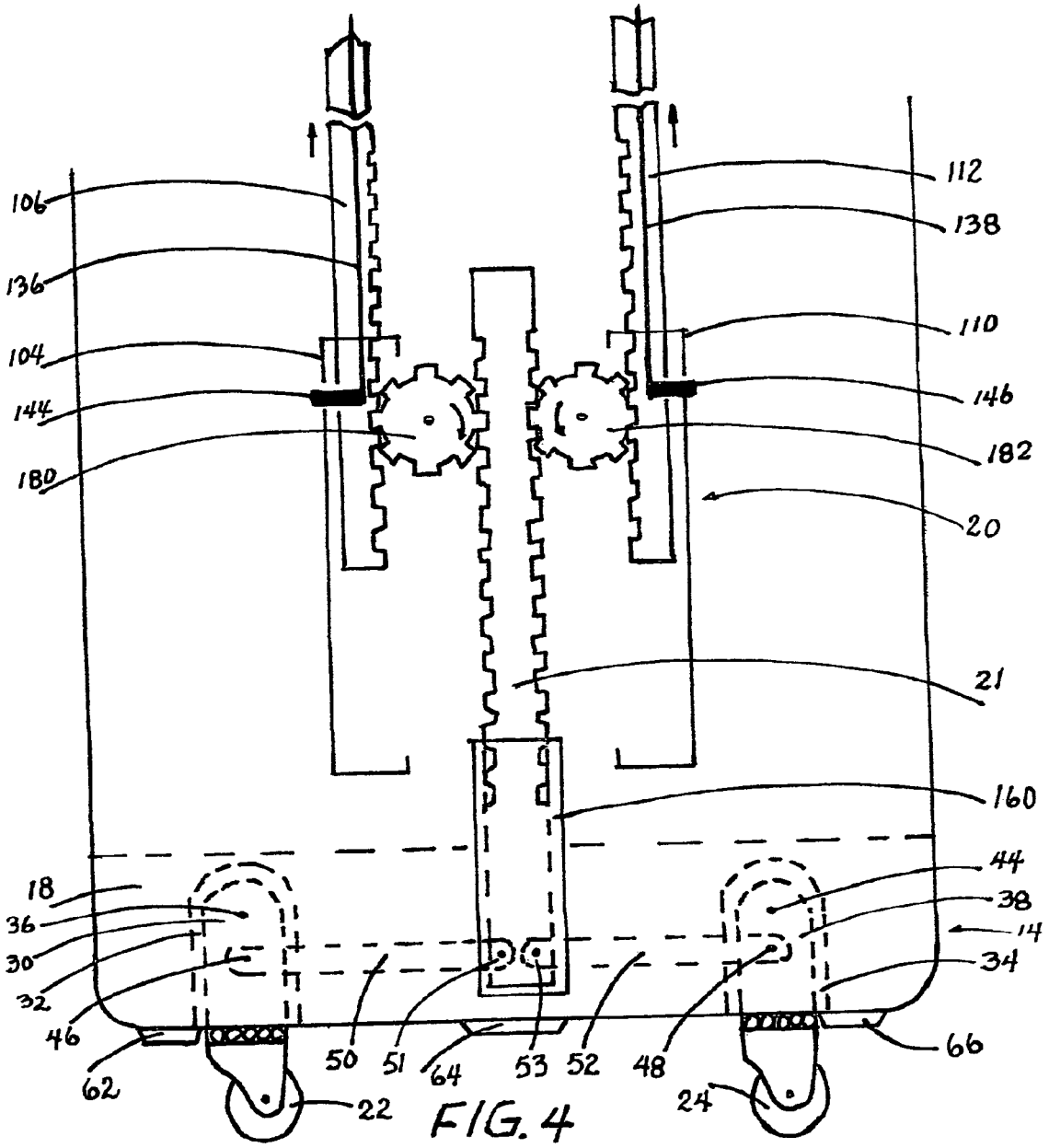
FIG. 4 shows a transparent frontal view of the toothed handle-shuttle system, with the lock placing the wheels in the exposed position.
Figure 9:
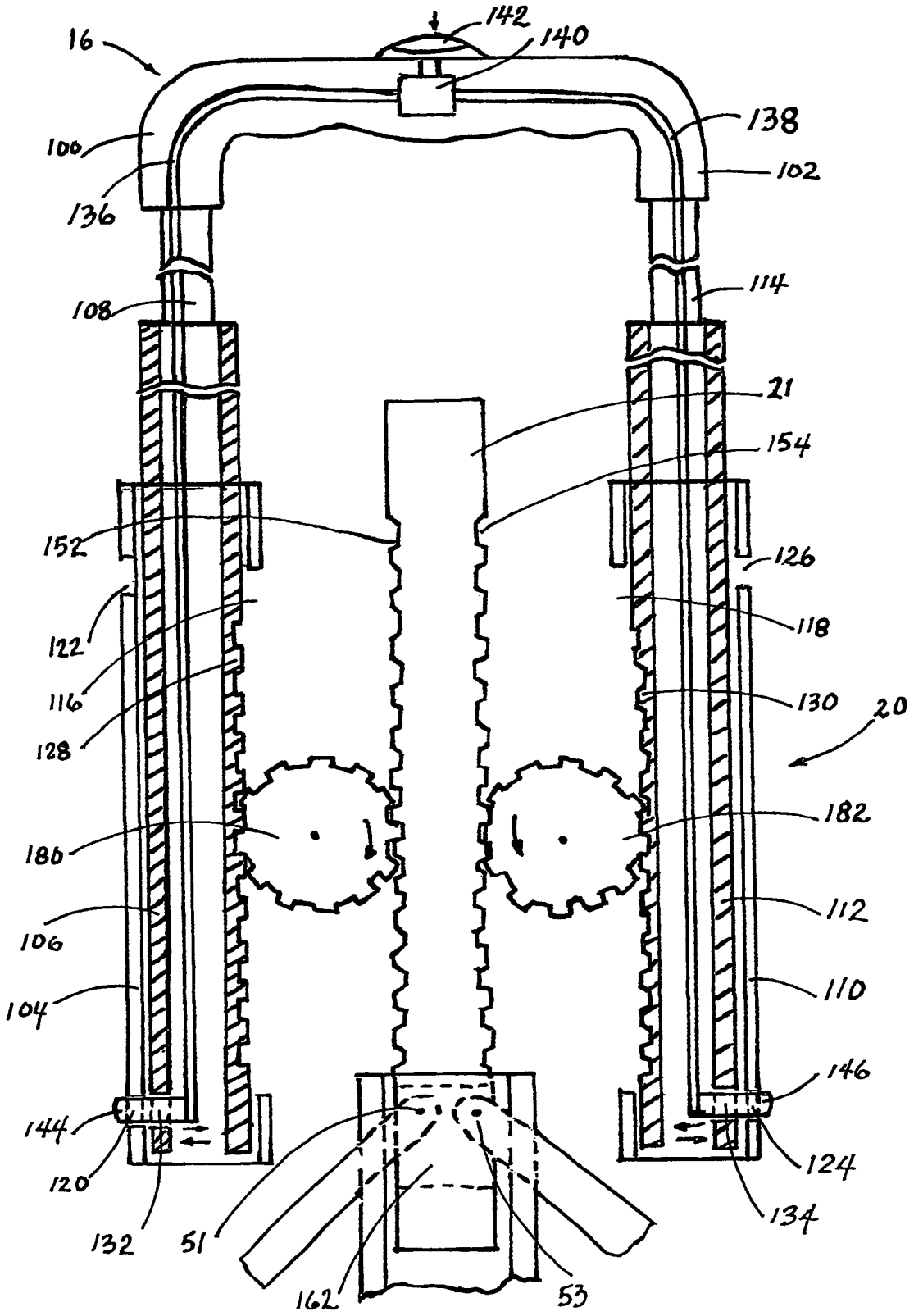
FIG. 9 shows a transparent view of the toothed handle-shuttle system.

As seen in FIG. 9, the bag 12 also has a no conventional toothed handle-shuttle system 20. The toothed handle-shuttle system 20 is proximal to the wheel system 14 end of the wheeled luggage system 10 and with the modified extended handle 16. As seen in FIG. 3 and FIG. 4, the toothed handle-shuttle system 20 interacts with position control plates 50, 52, which in turn move the wheels between exposed and hidden positions. The toothed handle-shuttle system 20 has a toothed shuttle 21. The toothed handle-shuttle system 20 will be described below.

The wheel system 14 has a housing 18 for receiving the wheels 22, 24, 26, 28. The position control plates 50, 52 connect the wheels to the toothed shuttle 21.

Moving the position control plates 50, 52, via the toothed handle-shuttle system 20, to the exposed position moves the wheels 22, 24, 26, 28 from the housing 18 to expose the wheels 22, 24, 26, 28 so that the user can wheel her luggage. Moving the position control plates 50, 52, via the toothed handle-shuttle system 20, to the hidden position move the wheels 22, 24, 26, 28 back into the housing 18, to hide the wheels 22, 24, 26, 28. Now the luggage can be stowed so as not to damage the wheels, or the wheels to cause damage. Also, hidden wheels leave the bottom of the luggage completely flat, making upright luggage more stable and better aesthetic.

Figure 5:
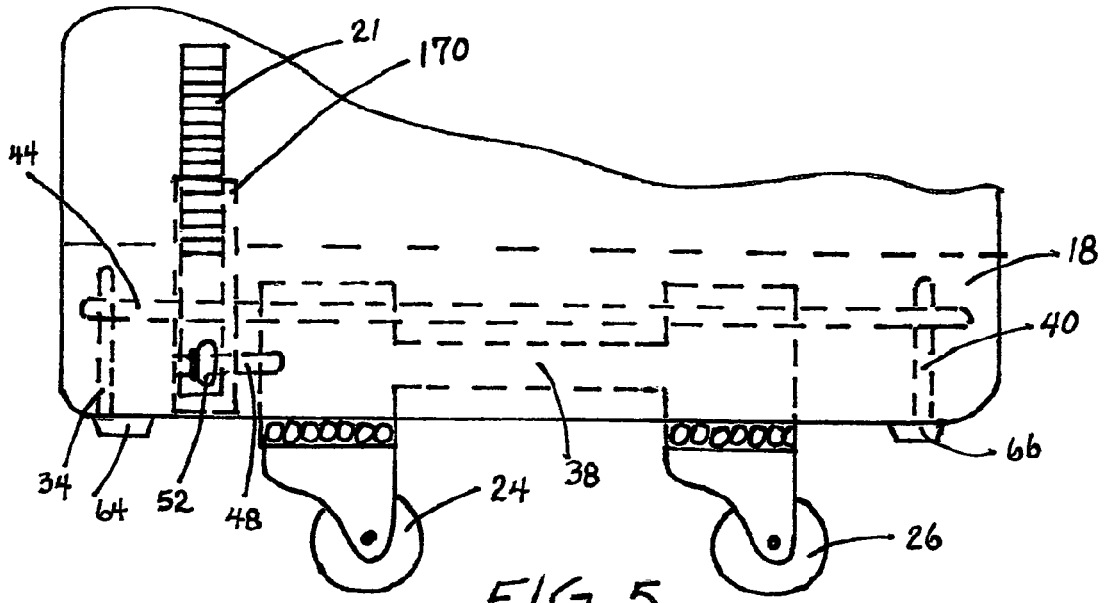
FIG. 5 shows a transparent partial side view of the toothed handle-shuttle system, with the lock placing the wheels of a folding wheel system in an exposed position.
Figure 6:
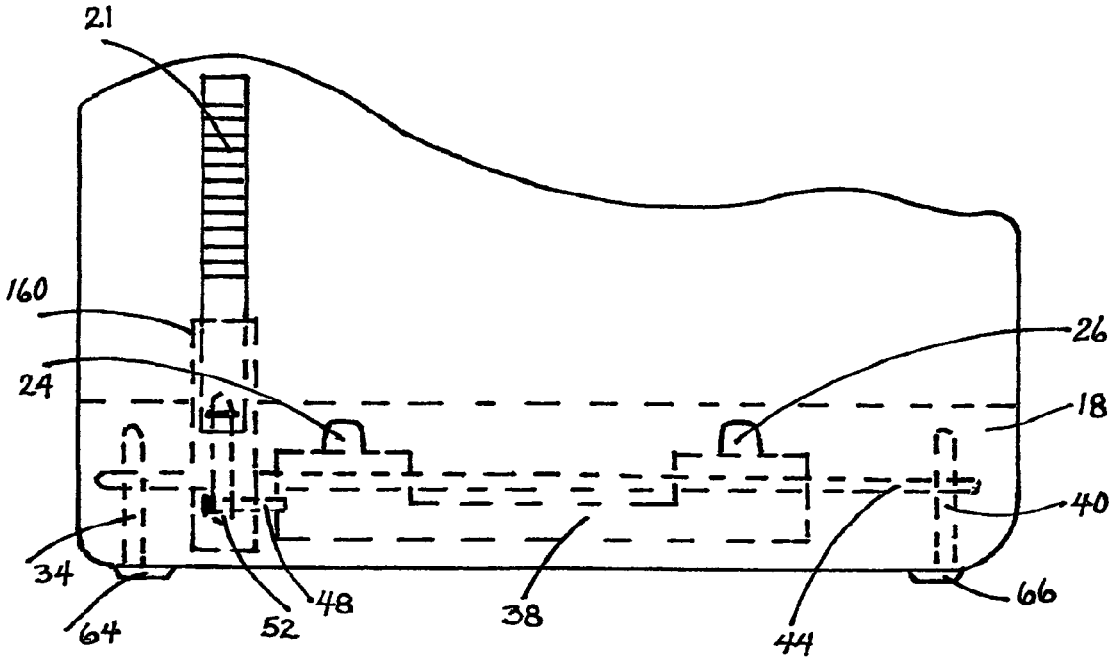
FIG. 6 shows a transparent partial side view of the toothed handle-shuttle system, with the lock placing the wheels of a folding wheel system in the hidden position.

FIG. 3 through FIG. 6 show the embodiment of the presently claimed invention having a folding wheel system. The wheels 22, 24, 26, 28 move between exposed and hidden positions by the wheels 22, 24, 26, 28 moving toward the center of the luggage and up into the housing 18 for receiving the wheels 22, 24, 26, 28. Typically, first, second, third and fourth wheels 22, 24, 26, 28 are received in the system housing 18. FIG. 4 and FIG. 5 illustrate the exposed position. FIG. 3 and FIG. 6 illustrate the hidden position.

As seen in FIG. 10, the first and fourth wheels 22, 28 are attached respectively to first and fourth wheel brackets 32, 42. A first bar 30 rotates around a first bracket-bar pin 36. The first bracket bar pin 36 is attached at one end to the first wheel bracket 32 and at the other end to the fourth wheel bracket 42. Similarly, on the other side, the second and third wheels 24, 26 are attached respectively to second and third wheel brackets 34, 40. A second bar 38 rotates around a second bracket-bar pin 44. The second bracket-bar pin 44 is attached at one end to the second wheel bracket 34 and at the other end to the third wheel bracket 40.

A first position control plate 50, having a bracket end pin 46 and a toothed shuttle end pin 51, joins the bracket 32, via the bracket end pin 46 and joins the toothed shuttle 21, via the toothed shuttle end pin 51. Similarly, as illustrated in FIG. 4, on the other side, a second position control plate 52, having a bracket end pin 48 and a toothed shuttle end pin 53, joins the bracket 34, via the bracket end pin 48 and joins the toothed shuttle 21, via the toothed shuttle end pin 53.

The wheel system has at least three legs 62, 64, 66 to hold the luggage when the wheels are hidden as illustrated in FIG. 3, FIG. 4, FIG. 10 and FIG. 11.

The toothed handle-shuttle system 20 will be described in detail now. As illustrated in FIG. 9, the modified extended handle 16 moves the wheels attached to the folding wheel mechanism from hidden to exposed position and vice versa.

The modified extended handle 16 has first and second ramifications 100, 102. The first ramification 100 has at least three tubes, first outer, middle and internal tubes 104, 106, 108. The second ramification 102 has at least three tubes, second outer, middle and internal tubes 110, 112, 114. The first and second outer tubes 104, 110 are fixed tubes attached to the bag 12. The first outer tube 104 has a first opening 116 in the interior of the tube. The second outer tube 110 has a second opening 118 in the interior of the tube. Further, the first outer tube 104 has first locking holes 120, 122 and the second outer tube 110 has second locking holes 124, 126. These holes will be used to lock the wheels in the exposed and hidden positions, as explained below.

The first and second middle tubes 106, 112 are inserted inside the first and second outer tubes 104, 110, respectively. The first and second outer tubes 104, 110 have the internal first and second openings 116, 118, respectively. The first and second outer tubes 106, 112 have toothed sections 128, 130 respectively in interior side of the tubes. The opening 116, 118 allow the toothed sections 128, 130 to be exposed internally. The first middle tube 106 has a first middle tube hole 132 and the second middle tube 112 has a second middle tube hole 134 for locking the wheels.

The first and second internal tubes 108, 114 are inserted inside the first and second middle tubes 106, 112, respectively. They provide extra extension of the modified extended handle 16.

The first and second internal tubes. 108, 114 have inside first and second flexible steel bands 136, 138, respectively. These flexible steel bands 136, 138 connect to a junction block 140. The junction block 140 is connected to a push button 142. When the push button 142 is pushed, the flexible steel bands 136, 138 move away from the internal surface of the internal tubes 106, 112 and outer tubes 104, 110. The flexible steel bands 136, 138 have attached at the end the protuberances 144, 146 respectively.

Figure 7:
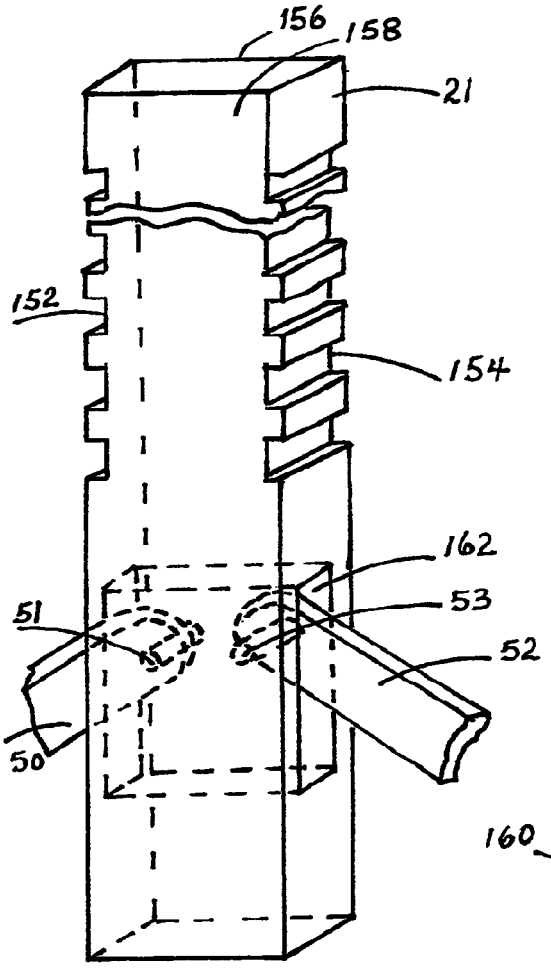
FIG. 7 shows a perspective view of the toothed shuttle belong to the embodiment referred to the toothed handle-shuttle system.

As illustrated in FIG. 9, the toothed handle-shuttle system 20 comprises a toothed shuttle 21. It has first and second two toothed sides 152, 154. The toothed shuttle 21 has a rectangular bar shape. The toothed shuttle 21 has parallel first and second faces 156, 158 and parallel first and second toothed sides 152, 154 respectively. As shown in FIG. 7, the first and second faces 156, 158 are perpendicular to the first and second toothed sides 152, 154 and parallel to the plate 160 attached inside to the bag surface 12 where the modified handle 16 is located.

Additionally, there is a rectangular-bar hollow 162 in the toothed shuttle 21 rectangular bar. As illustrated in FIG. 7, the first and second position control plates 50, 52 enter in the rectangular-bar hollow 162 and attach, allowing rotation to the first and second control plates 50, 52 by first and second control plate pins 51, 53, respectively, to the toothed shuttle 21.

Figure 8:
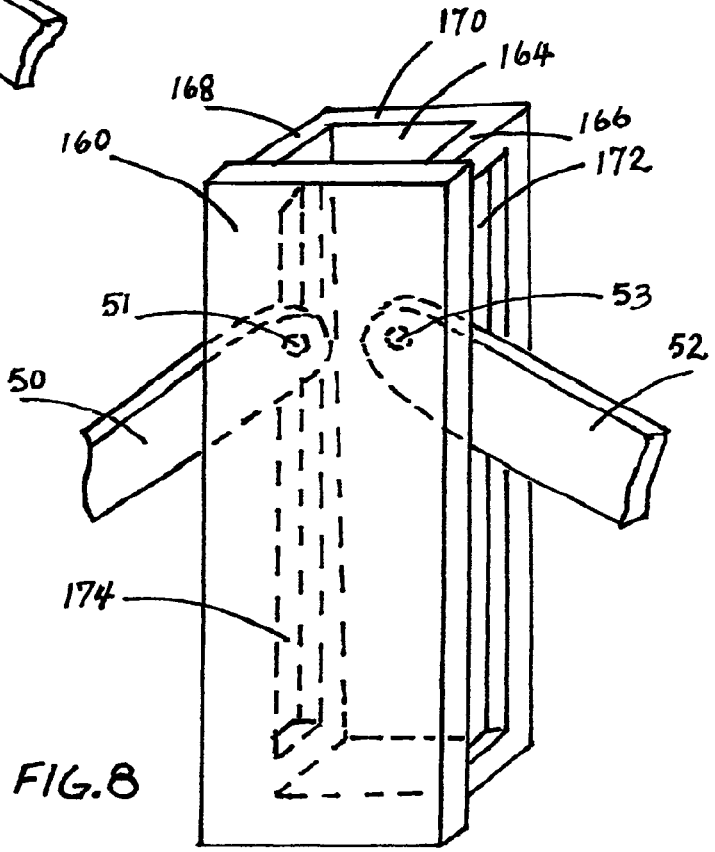
FIG. 8 shows a perspective view of the channel used by the toothed shuttle to move up and down allowing the wheels to be exposed or hidden.

As illustrated in FIG. 8, there is a rectangular housing 164. The toothed shuttle 21 slides smoothly within the rectangular housing 164. The rectangular housing 164 has four side plates 160, 166, 168, 170. First and second side plates 166, 168 separate the plates 160 and plate 170 respectively. The first and second side plates 166, 168 are parallel to each other and perpendicular to the third and forth plates 160, 170, respectively.

The first and second position control plates 50, 52 enter the first and second sides channels 172, 174 of the rectangular housing 164. As illustrated in FIG. 8, the third and fourth sides 160, 170 of the rectangular housing 164 will not have any opening.

The toothed handle-shuttle system 20 has first and second gears 180, 182 geared with the first and second toothed shuttle sides 152, 154. The gears 180, 182 geared with the toothed section 128 of first middle tube 106 and with the toothed section 130 of the second middle tube 112. The gears 180, 182 transmit the movement of the modified handle 16 to the toothed shuttle 21 and this to the wheeled folding system to expose or hide the wheels 22, 24, 26, and 28.

The gears 180, 182 create opposite movement between the toothed section tubes 128, 130 and the toothed shuttle 21. When a user pulls the modified handle 16 up, the toothed shuttle moves down, thereby exposing the wheels. When a user pushes the extended modified handle 16 down, the toothed shuttle 21 moves up hiding the wheels 22, 24, 26, and 28.

The flexible steel bands 136, 138 have the protuberances 144, 146 attached at their ends, respectively. The internal tubes 106, 112 have the holes 132, 134. Further the fixed tubes 104, 110 have the holes 120, 124*d*. When the protuberance 144, is inserted at the same time in the holes 132, 120 and the protuberance 146 inserted at the same time in the holes 134, 124 lock the wheel system 14 with the wheels in the hidden position.

The fixed tubes 104, 110 have other holes 122, 126 at some specific distance of the holes 120, 124. When a user pulls up the modified handle 16 the protuberances 144 insert in the holes 132, 122 and the protuberance 146 inserts in the holes 134, 126 while moving the wheels 180, 182 locking the wheel system 14 in the exposed position.

Figure 11:
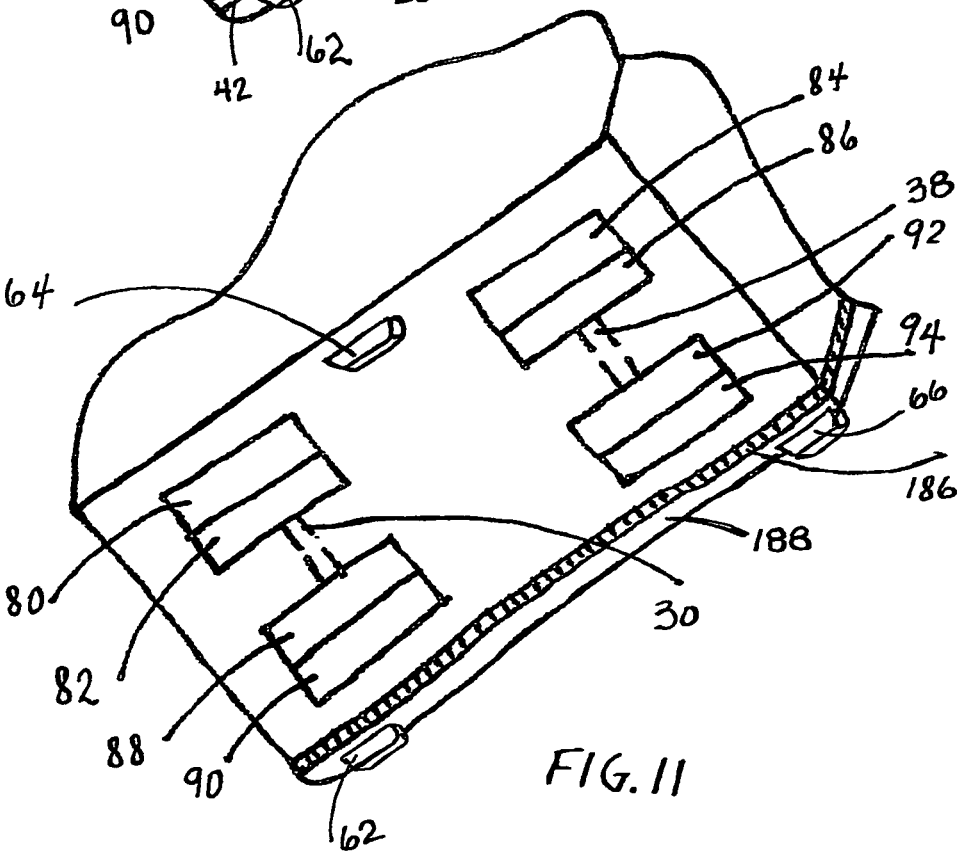
FIG. 11 shows a perspective view of the bottom of the luggage with wheels hidden and flaps closed.

As illustrated in FIG. 10 and FIG. 11, each exit of the four wheels has a pair of flaps 80, 82, 84, 86, 88, 90, 92 and 94 on spring hinges, allowing complete concealment of the hole when the wheels are hidden. When the wheels move to be exposed, the wheels push the flaps open. The bottom surface of the luggage 10, as illustrated in FIG. 10 and FIG. 11, has a closing mechanism 186, such as a zipper or one lock on each side of the luggage 12. Except one side for at least a hinge to allow closure of the lid 188 of the luggage 12.

The invention being thus described, it will be obvious that the same may be varied in many ways. Such variations are not to be regarded as a departure from the spirit and scope of the invention, and all such modifications are intended to be included within the scope of the following claims.

I claim:

1. A wheeled bag comprising:

a shuttle system, having a shuttle housing with first and second side plates opposite each other and first and second side channels defined therein and a bag mounting plate for attachment to an interior surface of the bag and a separator plate between the first and second plates and opposite the bag attachment plate, a toothed shuttle having first and second toothed sides opposite each other, first and second faces opposite each other and perpendicular to the first and second toothed sides, and handle and wheel ends, the toothed shuttle having a rectangular bar hollow defined at the wheel end of the toothed shuttle, the toothed shuttle inside the shuttle housing, whereby the first and second toothed sides face first and second side channels; and a toothed handle system having, first and second ramifications joined at a junction block with a push button at the junction block, first and second steel bands, inside the first and second ramifications, respectively, attached to the junction block and having first and second protuberances distal to the junction block, whereby pushing the push button moves the first and second protuberances, first and second internal tubes attached to the first and second ramifications having the first and second steel bands inside the first and second internal tubes, first and second middle tubes enclosing and attached to the first and second internal tubes, the middle tubes at the ends distal to the first and second ramifications having first and second middle tube holes, whereby the protuberances of the first and second bands exit the middle tubes via the middle holes, first and second toothed sections along the middle tubes opposite the first and second middle holes, the first and second toothed sections facing each other, first and second outer tubes having the first and second middle tubes, respectively, inserted therein, the first and second outer tubes having first and second retracted handle holes at ends distal to the first and second ramifications and the first and second extended handle holes at ends proximal to the first and second ramifications, whereby the first and second protuberances, when activated by push button, insert into the retracted handle holes when the handle is retracted, thereby locking the handle in a retracted position and locking the wheels in a hidden position and insert into the extended handle holes when the handle is extended, locking the handle in the extended position and locking the wheels in an exposed position, first and second outer tube openings facing each other, whereby the outer tube openings allow exposure of the toothed sections of the middle tubes; and first and second gears between the first and second toothed sections of the middle tube and the first and second toothed sides of the toothed shuttle, whereby movement of the toothed sections rotates the first and second gears so that the toothed shuttle moves within the shuttle housing; and a folding wheel system having first and second position control plates having shuttle ends and bracket ends, the shuttle ends of the position control plates attached to the rectangular bar hollow of the toothed shuttle by first and second control plate pins, whereby the first and second control plates rotate within the rectangular bar hollow as the toothed shuttle moves within the shuttle housing, first and second brackets at the bracket ends of the first and second position control plates attached by first and second bracket pins, the first bracket pin attached to first and fourth wheel brackets, the second bracket pin attached to second and third wheel brackets, first and fourth wheels attached by a first bar, second and third wheels attached by a second bar, whereby the wheels rotate around the bracket pins from an exposed position, outside of the system housing to a hidden position within the system housing when the position control plates move and the brackets attach to the bag proximal to their respective wheels.

2. The bag of claim 1, further comprising:

first, second, third and fourth bifold wheel covers, covering the wheel openings of the first, second, third and fourth wheels, the wheel covers having first and second flaps attached by spring hinges to opposite edges of the wheel openings, whereby the spring hinges hold the flaps flush with the bottom of the bag when the wheels are in the hidden position inside the system housing and when the wheels move to the exposed position outside the system housing, the wheels push the flaps perpendicular to the bottom of the bag allowing the wheels to contact the environment so that a user might wheel the bag.

* * * * *